US005642016A

United States Patent [19]

Shalvi

[11] Patent Number: 5,642,016

[45] Date of Patent: Jun. 24, 1997

[54] DRIVE CIRCUIT FOR A SOLAR LAMP WITH AUTOMATIC ELECTRICAL CONTROL OF THE LAMP OPERATING CONDITIONS

[76] Inventor: Ram Shalvi, 19 F The Manhatten 33 Tai Tam Rd., Hong Kong, Hong Kong

[21] Appl. No.: 507,063

[22] Filed: Jul. 26, 1995

Related U.S. Application Data

[63] Continuation of Ser. No. 952,857, filed as PCT/GB91/00866, May 30, 1991, abandoned.

[30] Foreign Application Priority Data

May 30, 1990 [GB] United Kingdom ..... 9012019

[51] Int. Cl.[6] ..... H05B 39/00

[52] U.S. Cl. ..... 315/94; 315/158; 315/149; 315/48; 315/DIG. 7; 315/DIG. 2

[58] Field of Search ..... 315/158, DIG. 2, 315/94, 149, 360, 46, 48, 49, DIG. 7; 323/906; 362/183

[56] References Cited

U.S. PATENT DOCUMENTS

| | | | |
|---|---|---|---|
| 3,389,299 | 6/1968 | Bell | 315/DIG. 7 |
| 4,398,128 | 8/1983 | Wollank . | |
| 4,410,930 | 10/1983 | Yachabach | 362/145 |
| 4,486,820 | 12/1984 | Baba et al. | 362/183 |
| 4,746,841 | 5/1988 | Ogawa | 315/102 |
| 5,155,668 | 10/1992 | Tanner et al. | 362/183 |
| 5,179,326 | 1/1993 | Nilssen | 375/209 R |
| 5,217,296 | 6/1993 | Tanner et al. | 362/183 |

FOREIGN PATENT DOCUMENTS

| | | |
|---|---|---|
| 0233605 | 2/1987 | European Pat. Off. . |
| 0937577 | 9/1963 | United Kingdom . |

*Primary Examiner*—Robert Pascal
*Assistant Examiner*—Darius Gambino

[57] ABSTRACT

A solar lamp drive circuit is arranged to delay start-up while a current is supplied to the lamp filament to warm up the filament. During operation, the back e.m.f. induced in the lamp is sampled, and, if operating conditions deteriorate, the current to the filament is reapplied automatically and the power supply to the lamp increased.

4 Claims, 1 Drawing Sheet

DRIVE CIRCUIT FOR A SOLAR LAMP WITH AUTOMATIC ELECTRICAL CONTROL OF THE LAMP OPERATING CONDITIONS

This is a continuation of application Ser. No. 07/952,857, filed as PCT/GB91/00866, May 30, 1991, now abandoned.

BACKGROUND OF THE INVENTION

1. Field of the Invention

The invention relates to drive circuits.

2. Description of Prior Art

The invention relates more particularly to a drive circuit for use in controlling a lamp driven by solar cells. Such lamps are used for all forms of lighting applications, especially exterior light around dwelling places. The lamps are arranged to be driven by rechargeable batteries provided with solar panels so that they rely mainly or solely on receiving charging current generated by the solar cells during day light hours.

Commonly a fluorescent tube or lamp is used and driven via an electronic ballast. Battery energy is used to provide a high frequency high voltage power source which is applied between the terminals of the lamp. The ballast consists of a multi-phase transformer with a free-running oscillator.

At present the lamps that are known or that have been proposed are relatively inefficient in terms of power consumption, and the working life of the lamp tends to be limited due to poor control of the power supply to the lamp.

SUMMARY OF THE INVENTION

According to the invention there is provided a lamp drive circuit for connection between a battery power supply and the terminals of a fluorescent lamp. The battery power supply has solar cells and a battery. The lamp drive circuit includes an oscillator and a step-up transformer arranged to supply high frequency power across the terminals of the lamp. It also includes a switch that is connected to one of the filaments of the lamp to control a warm up power supply, and a timer that controls the switch. This lamp drive circuit is arranged to delay the application of main operating power from the transformer at start-up to allow the filament of the lamp to warmup, and the timer is arranged to cause the switch to remain closed until the lamp has been turned on for at least a few seconds.

The circuit may include a sampling circuit for monitoring the operating condition of the lamp and for causing the switch to turn on if the lamp operating condition deteriorates to a predetermined condition.

The oscillator output power may be arranged to be reduced from a high starting level to a predetermined working level once the lamp has been on for a few seconds.

The circuit may include a manually adjustable current regulator for altering the brightness of the lamp in use.

The sampling circuit may be arranged to increase the oscillator output power if the lamp operating condition deteriorates to the predetermined condition.

DESCRIPTION OF THE PREFERRED EMBODIMENT

Figure 1:
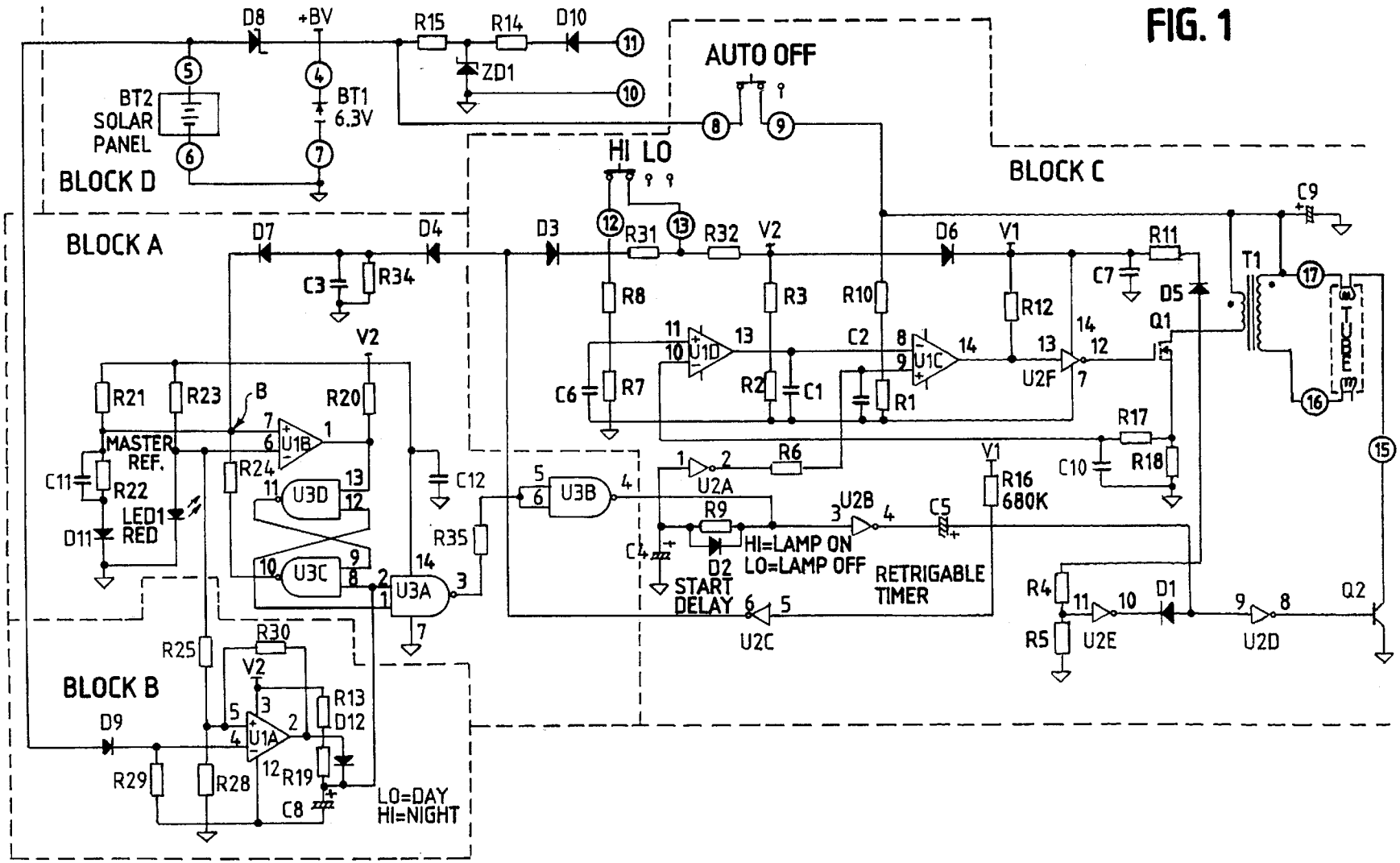
FIG. 1 shows the circuit diagram for a lamp drive circuit constructed according to the present invention.

Referring to FIG. 1, the lamp drive circuit is shown consisting of blocks A, B, C and D. Broadly, block A is a battery condition detecting circuit which is arranged to control application of power to a lamp in a manner that prevents using the battery if the charge of the battery is too low. Block B is a monitoring circuit which monitors the outside light conditions to influence the application of power accordingly. Block C is the main part of the lamp drive circuit. Block D is basically a charging circuit, but it shows the battery as well as a solar panel.

Dealing with the circuits in more detail, block A includes a voltage comparator U1B with a resistor R20 connected to its output to hold up its output voltage. A latch is formed by gates U3C and U3D. The output of the latch at U3C is set to high by an output from block B (see below). A battery voltage sampling network consists of resistors R21 and R22, diode D11 and capacitor C11. The input threshold of the sampling network is reduced after turn-on by a feedback resistor R24. A master reference network consists of resistor R23 and a light emitting diode LED1 (which has a negative temperature coefficient). A diode D11 compensates for the thermal drift of LED1 and a capacitor C11 acts to decouple noise.

If the sampled voltage is below the master reference, the output of the comparator U1B goes low and sets the latch output to low. As a result the output of NAND-gate U3A goes high which, as seen below, causes the lamp to turn off. The resistor 24 acts to increase the sensitivity of the battery sampling network.

A hold circuit (block A) consists of diodes D4 and D7, a resistor R34 and a capacitor C3. When diode D4 is forward biased and supplied from the block C (see below), the capacitor C3 fully charges almost instantaneously. Diode D7 will become forward biased in turn and will apply a voltage to increase an input voltage of the comparator U1B via comparator U3C. As a result the output of the comparator U1B is held high. In other words, the NAND-gate U1B is disabled. It will remain disabled until the supply from block C is removed. Capacitor C3 then discharges through the resistor R34 until the diode D7 is cut off. This releases comparator U1B to again work normally. The hold circuit is designed to disable the comparator U1B before the lamp becomes stable and for approximately 0.5 seconds thereafter.

In block B, the monitoring circuit is arranged to monitor the light intensity of the environment and cause the lamp to turn off when that intensity is above a certain level. A voltage comparator U1A with an hysteresis loop of a resistor R30 has its input connected between resistors R25 and R28. These resistors divide the output of diode LED1 to provide a smaller reference voltage for the comparator U1A. The voltage across a solar cell (see block D) is proportional to light intensity and this voltage is applied across a resistor R29 via a diode D9. The diode D9 will always be forward biased unless it is very dark. If the voltage across the resistor R29 is higher than the reference voltage at the comparator U1A, the comparator output goes low. Capacitor C8 then discharges gradually through a resistor R19 until the latch circuit (of block A) resets. As a result the output of NAND-gate U3A goes high and causes the lamp to be turned OFF.

By contrast, when the voltage across the resistor R29 is lower than the reference voltage (the reference voltage is located at the junction between the resistors R25 and R28) the output of the comparator U1A goes high, and the capacitor C8 is quickly charged through resistor R13 and diode D12. As a result, the input connected to block A goes high. If the output of the latch circuit (block A) is also high, the output of the NAND gate U3A goes low, so that the lamp will be turned ON.

It will be noted that the time delay provided by the resistor R19 and capacitor C8 prevents the monitoring circuit from responding to transient light changes, like, e.g., those due to car headlights or torches in the vicinity of the lamp. It will also be noted that the circuit responds to the voltage across the solar cell and does not require or use a separate light intensity metering device or anything similar.

Referring to block C, gate U3B receives start signals from block A to switch on the lamp. A start delay circuit consists of a resistor R9, a capacitor C4 and a diode D2. Typically a 10 second start delay is provided by the delay circuit. However, the lamp can be turned off instantly by including the diode D2. A retriggerable timer consists of a resistor R16 and a capacitor C5. On receipt of a start signal, the output of an inverter U2D goes low and the output of an inverter U2D turns on a transistor Q2. At the same time, capacitor C3 begins to charge up via diode D4 (see block A) and capacitor C5 charges up via resistor R16. As a result current passes through one of the lamp elements to warm up the element via the transistor Q2, which acts as a switch to turn the current ON and OFF. The output of inverter U2C is acting at this time to inhibit the battery condition detecting circuit (block A) and to increase the power that can be supplied by the lamp drive circuit to the maximum. The inhibition is timed to be about double the start delay time so that the filament current, through the transistor Q2, is applied while the lamp is OFF and lasts until the lamp is working at high capacity after being turned ON. At the end of the inhibition time period, the transistor Q2 is turned OFF and the power supplied to the lamp is adjusted to an optimum setting below a starting setting.

A sampling network consisting of resistors R4 and R5 monitors the back e.m.f. induced in the lamp. A low back e.m.f. indicates the lamp is stable and is operating in the secondary breakdown region. A high back e.m.f. indicates the lamp is operating in an unstable region. An inverter U2E is connected to the junction between the resistors R4 and R5. If the voltage at the junction rises above a predetermined threshold corresponding to non-stable lamp operation, that is, corresponding to the operating condition of a lamp that has deteriorated to a predetermined condition, the output of inverter U2E goes low and the retriggerable timer and the transistor Q2 are turned ON immediately. Thus, a restart condition is repeated, increasing power to the lamp and applying a current to one of the lamp filaments.

The sampling network thus automatically attempts to maintain the lamp in a stable working secondary breakdown condition. If a lamp is allowed to work under unstable conditions, the life of the lamp will be considerably shortened.

The lamp is supplied with its main power by a closed loop oscillator consisting basically of amplifiers U1D and U1C, inverter U2F, a mosfet Q1 and a resistor R18. The oscillator converts the battery d.c. supply to a high energy high frequency current through a step-up pulse transformer T1. Oscillations can be stopped by supply through an inverter U2A and a biassing network consisting of resistors R1, R10 and R6 and a capacitor C2. The duty cycles are determined by the d.c. input level of amplifier U1D supplied via a network consisting of resistors R31, R32, R7 and R8 and a capacitor C6.

The time constant of the oscillator is determined by a filter consisting of a resistor R17 and a capacitor C10. A high d.c. input level or a greater capacitance for capacitor C10 results in a longer ON cycle, or vice versa. The OFF duty cycle is determined by the time taken for a capacitor C1 to charge from $V_{SS}$ to $\frac{1}{3}$ $V_{DD}$ in the network including the resistors R2 and R3.

A manual switch for altering the intensity of the lamp is provided across a resistor R31. When the switch is closed, the d.c. input level of the amplifier U1D is increased. When the diode D3 is forward biased as a result of the output of the inverter U2C being high (as explained earlier, this condition applies during start-up and when unstable operating conditions are detected), the resulting d.c. input level of the amplifier U1D is increased to three times its normal level. When the switch is positioned to short out the resistor R31, the d.c. input level is increased by about 20%.

The voltage across the resistor R18 is proportional to the mosfet source current which is transferred to the lamp by the transformer T1. This is passed to a low pass filter formed by a resistor R17 and a capacitor C10 to decouple the high frequency component in the switching current. The output of the low pass filter provides an input to the amplifier U1D to maintain the ON cycles.

The start of operation of the oscillator is as follows: Once the start delay circuit and retriggerable timer have timed out, the output of inverter U2A goes low. The voltage across the resistor R18 is initially zero and is fed to the amplifier U1D. The output of amplifier U1D is then at $\frac{1}{2}$ $V_{DD}$; the voltage across resistors R1 and R2 are equal and the output of amplifier U1C is low. Thus, the output of inverter U2F is high and turns on the mosfet Q1. The current then applied to the resistor R18 is increasing due to the inductance of the transformer T1. When the voltage across the resistor R18 is greater than the non-inverting value of the amplifier U1D, its output (the output of the amplifier U1D) goes low and a capacitor C1 discharges. Then the output of the amplifier U1C goes high, the output of the inverter U2F goes low, and the mosfet Q1 turns off. This cuts off the current to the resistor R18, causing the output of the amplifier U1D to go high. The capacitor Cl then charges up until it reaches $\frac{1}{3}$ $V_{DD}$, which is above the non-inverting input level of the amplifier U1C, causing the output of the amplifier U1C to go low. Thus, the mosfet turns ON again and the cycle is repeated until the non-inverting input level of the amplifier U1C rises to $\frac{2}{3}$ $V_{DD}$. The oscillator is designed to reach stable oscillations at a frequency between about 24 to 33 $KH_z$.

A mosfet is used to ensure fast switching time for the current applied to the lamp. To ensure rapid switching the supply to the inverter U2F is separated from the battery voltage by a diode D6. At the beginning of oscillations, the diode D6 is forward biased and the voltage applied to the inverter U2F is 0.6 volts less than the voltage applied to the inverter U2C. However, capacitor C7 gradually charges up, through a diode D5 and a resistor R11, due to the back e.m.f. induced in the transformer T1. As a result the voltage applied to the inverter U2F will be approximately 2 volts higher than the voltage applied to the amplifier U1C. Higher $V_{DD}$ level applied to the mosfet Q1 tends to speed up the response time and hence improve the efficiency in working with the high frequency pulse transformer.

It will be seen that any high frequency spikes occurring in the back e.m.f., that are generated as the lamp is operating, especially during early stages after start-up, are used to charge up the capacitor C7 to improve the working efficiency of the lamp. In block D, a Schottkey diode D8 allows the solar cell BT2 to charge a battery BT1 at minimum loss due to its forward volt drop characteristics. The diode D8 blocks any battery discharge towards the light detector intensity circuit of block B.

An external charging circuit formed of resistors R14 and R15, a diode D10 and a zener diode ZD1 enable the solar lamp to be recharged from an external power adapter. Resistors R14 and R15 limit the charging current, and the zener diode ZD1 protects the battery from over-charging. The diode 10 prevents the battery from discharging via the external adapter.

The described arrangement therefore provides, at turn-on, a delay to allow the lamp filament to warm up. A filament current may be applied again during operations and well after turn-on if the lamp operating condition deteriorates, in order to prevent the lamp from operating at too low a current or in an unstable condition for too long which would result in shortening the life of the lamp. Although the described circuit is more sophisticated than currently used comparable lamp drive circuits and therefore somewhat more costly, the use of the circuit not only leads to much longer lamp operating life but also leads to a greater efficiency in power consumption. The lamp can be run at an optimum power rating where secondary breakdown is a stable occurring condition. Further, because the lamp operating conditions are continually monitored automatically, and because those conditions are automatically adjusted when required, no continuous extra power is needed to take into account unforeseen variations. In other words, the lamp need not be over-powered simply to cope with the worst predictable operating conditions. A cruder or simpler drive circuit is typically adjusted to avoid under-supply in all environments, at the inevitable cost of always supplying more power than is actually required, and of using up the battery charge more quickly than necessary.

I claim:

1. A lamp drive circuit for connection between a batter power supply and the terminals of a lamp, where the battery power supply incorporates solar cells and a battery, the lamp drive circuit comprising:

a. an oscillator;

b. a step-up transformer coupled to the oscillator wherein the oscillator and the step-up transformer are arranged to supply high frequency power across the terminals of the lamp;

c. a switch connected to one of the filaments of the lamp to control a warm up power supply to the filament; and d. a sampling circuit for monitoring back e.m.f. induced in the lamp connected to the switch for monitoring the operating condition of the lamp, wherein the switch is arranged to turn on if the lamp operating condition deteriorates to a predetermined condition.

2. A lamp drive circuit according to claim 1, further comprising a timer connected to the switch, wherein the timer is arranged to delay the application of power at start-up in order to allow the filament of the lamp to warm up, and wherein the timer further causes the switch to remain closed until after the lamp has been turned on for at least a few seconds.

3. A lamp drive circuit according to claim 2, wherein the oscillator output power is arranged to be reduced from a high starting level to a lower predetermined level once the lamp has been on for a few seconds.

4. A lamp drive circuit according to claim 2, wherein the sampling circuit is arranged to increase the oscillator output power if the lamp operating condition deteriorates from the optimum condition.

* * * * *